US006325529B1

(12) United States Patent
Ito

(10) Patent No.: US 6,325,529 B1
(45) Date of Patent: Dec. 4, 2001

(54) VEHICLE LAMP WITH SHADE HAVING REFLECTOR FOLLOWING EDGE

(75) Inventor: Takaya Ito, Shizuoka (JP)

(73) Assignee: Koito Manufacturing, Inc., Ltd. (JP)

( * ) Notice: Subject to any disclaimer, the term of this patent is extended or adjusted under 35 U.S.C. 154(b) by 0 days.

(21) Appl. No.: 09/439,783

(22) Filed: Nov. 12, 1999

(30) Foreign Application Priority Data

Nov. 16, 1998 (JP) ..... 10-324686

(51) Int. Cl.[7] ..... F21V 11/16

(52) U.S. Cl. ..... 362/539; 362/507; 362/509; 359/613

(58) Field of Search ..... 362/459, 487, 362/506, 507, 538, 539, 505, 351; 359/515, 227, 613

(56) References Cited

U.S. PATENT DOCUMENTS 4,882,660 * 11/1989 Liverance et al. ..... 362/226
5,130,904 * 7/1992 Ohshio et al. ..... 362/156
5,567,033 * 10/1996 Tanaka et al. ..... 362/510
5,611,612 * 3/1997 Choji et al. ..... 362/459
5,879,073 * 3/1999 Hori et al. ..... 362/344
6,132,068 * 10/2000 Katsumata ..... 362/351

* cited by examiner

*Primary Examiner*—Sandra O'Shea
*Assistant Examiner*—Ismael Negron
(74) *Attorney, Agent, or Firm*—Fish & Richardson P.C.

(57) ABSTRACT

A vehicular headlamp with a shade that even though the reflective surface of a reflector is constituted of a plurality of reflective elements, the generation of stray light is minimized while a decrease in utilization luminous flux is reduced to the minimum. The reflective surface (20*a*) of a reflector (20) is constituted of a plurality of reflective elements 20*s*) that are the divided rectangular segments each of which is longer than is wide. The upper end edge B of the reflective surface (20*a*) has a curved configuration having irregularities respectively in reflective elements (20*s*). However, the rear end edge (24Aa) in the upper end portion (24A) of a shielding cap (24) is set to have a curved configuration obtainable from a line of intersection D between a horizontal plane forming an area (24A1) near the rear end edge of the upper end portion (24A) and an imaginary curved plane (C) formed by connecting together the light emission center (A) of a light source bulb (18) and the upper end edge (B) of each reflective element (20*s*). Consequently, the incidence of light on the upper wall surface (20*c*) can be stopped substantially without impeding the incidence thereof on the reflective surface (20*a*).

6 Claims, 5 Drawing Sheets

VEHICLE LAMP WITH SHADE HAVING REFLECTOR FOLLOWING EDGE

BACKGROUND OF THE INVENTION

This invention relates to a vehicle headlamp fitted with a shade.

Many vehicle headlamps are often fitted with shades in order to avoid causing oncoming vehicle drivers and pedestrians to be blinded by the glare of headlamps.

As shown in FIG. 5, a shade 2 is arranged so that direct light from a light bulb 4 is shielded by a shielding cap 2*a*. When a reflector 6 has a reflective surface 6*a* extending forward from the upper end edge of the reflector 6 as shown in FIG. 5, shielding of direct light incident on the upper wall surface 6*b* from the light source bulb 4 is desirable in view of preventing the generation of stray light as a glaring source.

Therefore, it has heretofore been contrived to block light incident on the upper wall surface 6*b* by forming the upper end portion 2*b* of the shielding cap 2*a* so that the upper end portion 2*b* may be extended backward further than the other portion as shown in FIG. 5.

In a case where the reflective surface of the reflector is constituted of a plurality of reflective elements, however, the reflective surface has irregularities on a reflective element basis. Consequently, only forming the rear end edge of the upper end portion of the shielding cap into a simply curved shape as before cannot stop the incidence of light on the upper wall surface 6*b* without impeding the incidence of light on the reflective surface 6*a*.

In other words, a problem develops from the fact that if it is attempted to prevent the generation of such stray light in the conventional vehicular headlamp, utilization luminous flux (the amount of light incident on the reflective surface 6*a*) may largely be decreased, whereas if it is attempted not to greatly decrease the utilization luminous flux, a large amount of stray light may be generated.

SUMMARY OF THE INVENTION

An object of the present invention made in view of the foregoing problems is to provide such a vehicular headlamp with a shade that even though the reflective surface of a reflector is constituted of a plurality of reflective elements, the generation of stray light is minimized while a decrease in utilization luminous flux is reduced to the minimum.

The present invention is intended to accomplish the object above by contriving to provide a novel configuration for the rear end edge of the upper end portion of a shielding cap.

According to the present invention, a vehicular headlamp comprises a light source bulb, a reflector having a reflective surface for reflecting light from the light source bulb forward and an upper wall surface extending forward from the upper end edge of the reflective surface, an area near the upper end edge of the reflective surface is divided into a plurality of vertically-striped reflective elements, and a shade having a shielding cap for shielding the direction light directed forward from the light source bulb, in that the rear end edge of the upper end portion of the shielding cap is set to have a curved configuration substantially similar to a curved configuration obtainable from a line of intersection between a curved plane forming the upper end portion of the shielding cap and an imaginary curved plane formed by connecting together the light emission center of the light source bulb and the upper end edge of each reflective element.

On condition that the area near the upper end edge of the "reflective surface" is constituted of the plurality of divided vertically-striped reflective elements, any area other than the area near the upper end edge thereof may be constituted of a plurality of reflective elements or formed of a single curved plane such as a rotary parabolic plane or the like.

The configuration of the rear end edge of the portion other than the aforementioned "rear end edge of the upper end portion of the shielding cap" is not particularly restrictive.

As shown by the arrangement above, since the area near the upper end edge of the reflective surface of the reflector is constituted of the plurality of divided vertically-striped reflective elements according to the present invention, the upper end edge (i.e., a line of intersection between the reflective surface and the upper wall surface) of the reflective surface has the curved configuration having irregularities in the respective reflective elements. However, the rear end edge of the upper end portion of the shielding cap of the shade is set to have a curved configuration substantially similar to the curved configuration obtained from the line of intersection between the curved plane forming the upper end portion and the imaginary curved plane formed by connecting together the light emission center of the light source bulb and the upper end edge of each reflective element, whereupon the incidence of light on the upper wall surface can be stopped substantially without impeding the incidence thereof on the reflective surface.

Therefore, even in the case where the reflective surface is constituted of the plurality of reflective elements in the vehicular headlamp fitted with the shade according to the present embodiment of the invention, the generation of stray light can be minimized while a decrease in utilization luminous flux is reduced to the minimum.

Although the configuration of the curved plane forming the aforementioned "upper end portion of the shielding cap" is not particularly restrictive, formation of the curved plane forming the upper end portion thereof into the substantially horizontal plane in the area near the rear end edge of the upper end portion of the shielding cap makes it possible to not only relatively easily calculating the line of intersection between both the aforementioned curved planes but also machining the rear end edge of the upper end portion of the shielding cap.

DETAILED DESCRIPTION OF THE PREFERRED EMBODIMENTS

An embodiment of the invention will now be described with reference to the drawings.

Figure 1:
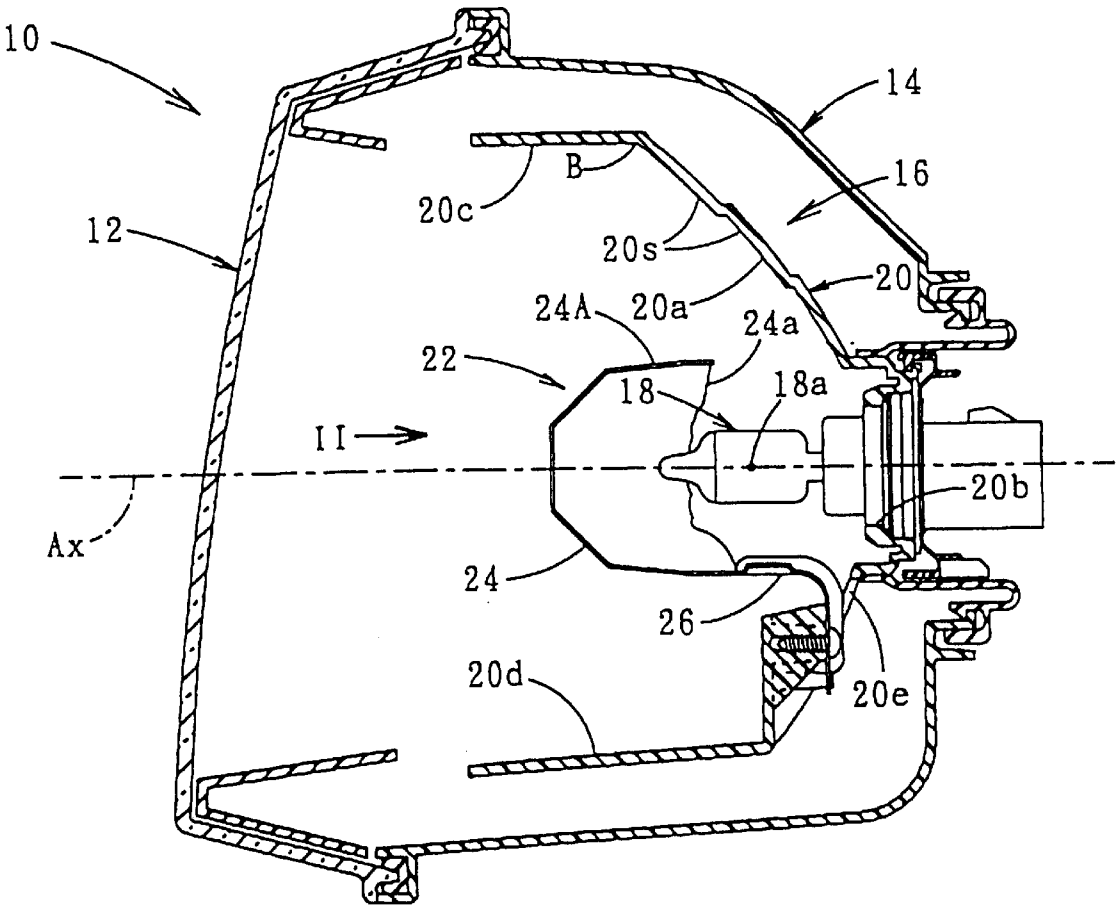
FIG. 1 is a sectional side view of a vehicular headlamp embodying the present invention.
Figure 2:
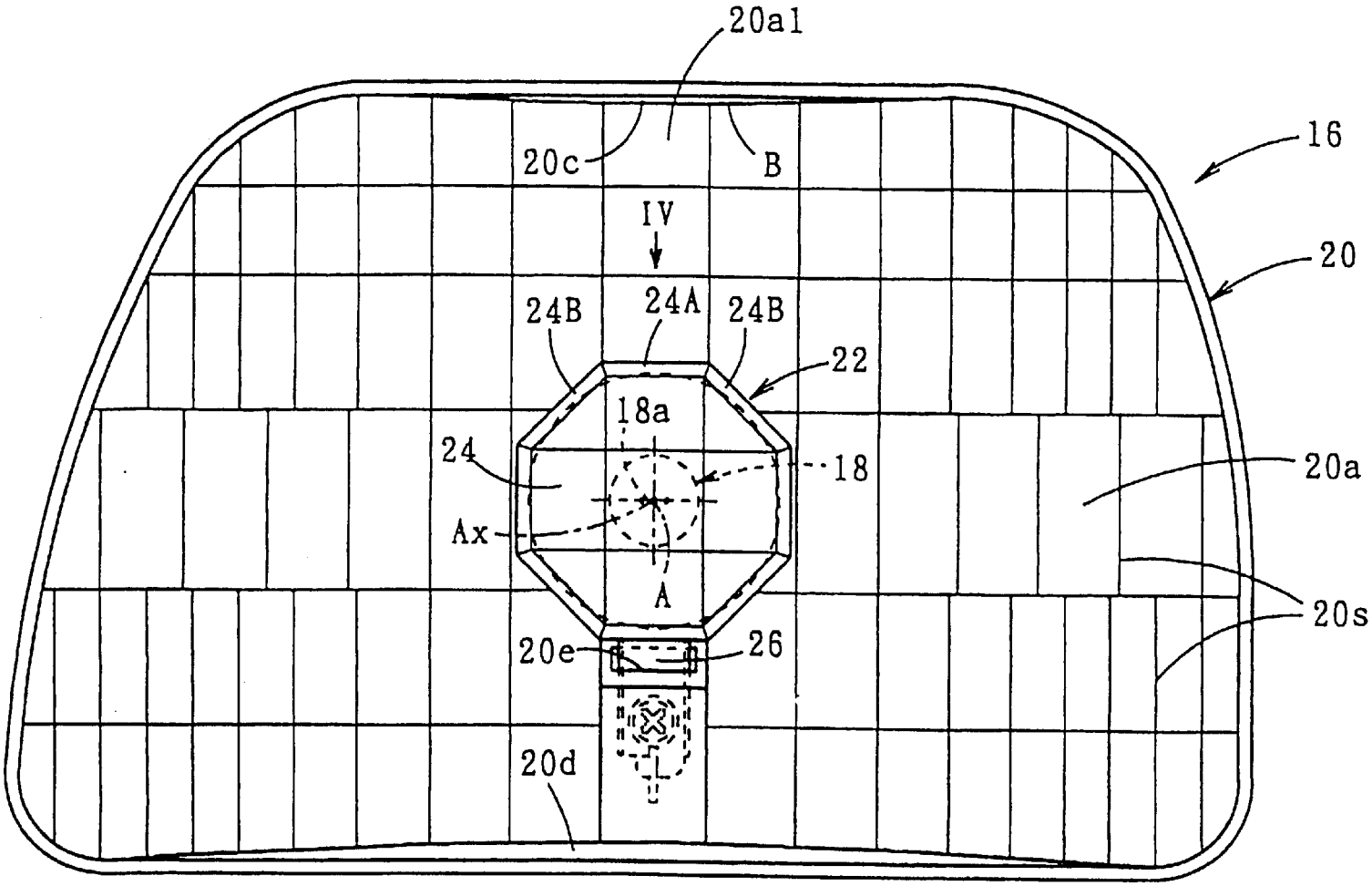
FIG. 2 is a view taken in the direction of an arrow II of FIG. 1.

FIG. 1 is a sectional side view of a vehicular headlamp embodying the present invention; and FIG. 2, a view taken in the direction of an arrow II of FIG. 1.

As shown in FIGS. 1 and 2, this vehicular headlamp 10 includes a lens 12 and a lamp body 14 that form a lamp chamber in which a reflector unit 16 is provided to be adjustable its tilt in vertical and horizontal directions.

Further, the reflector unit 16 includes a light source bulb 18, a reflector 20 and a shade 22.

A light source bulb 18 is a halogen bulb of a so-called HB1 (9004) type and securely inserted into a bulb inserting hole 20*b* in the rear top portion of the reflector 20 so that a low-beam filament 18*a* may be situated in a predetermined position on the optical axis Ax of the reflector 20.

The reflector 20 has a reflective surface 20*a* that is formed from a plurality of reflective elements 20*s* on the rotary parabolic surface with the optical axis Ax as a center axis. Consequently, light from the light source bulb 18 is diffused, deflected and reflected forward by the reflective surface 20*a*. The plurality of reflective elements 20*s* are divided in rectangular segments each of which is longer than is wide. In the upper and lower areas of the reflective surface 20*a*, the segments are formed so that the lateral width of each segment is gradually decreased toward both the lateral side portions from the optical axis Ax.

The shade 22 includes, in the elevational view of the lamp, a shielding cap 24 externally in the form of a polygon having a regular octagonal shape and a fitting stay 26 extended from the rear edge of the lower end portion of the shielding cap 24 and fixed to the reflector 20.

The shielding cap 24 is used for shielding the direct light that is not only emitted from the light source bulb 18 in the forward direction of the lamp but also incident on both the upper wall surface 20*c* and lower wall surface 20*d* of the reflector 20. The reflector 20 is such that the profile of its reflective surface 20*a* is laterally asymmetrical with respect to the optical axis Ax. Accordingly, the profile of the rear end edge 24*a* of the shielding cap 24 is also laterally asymmetrical with respect to the optical axis Ax (see FIG. 3).

The fitting stay 26 is formed integrally with the shielding cap 24 and bent into a substantially L-shape so that it may be extended downward after being extended backward from the rear edge of the lower end portion of the shielding cap 24. The fitting stay 26 is inserted into a fitting-stay inserting hole 20*e* formed in the lower area of the reflective surface 20*a* of the reflector 20 from above and in this condition, fixed to the reflector 20 with a screw from behind.

Figure 3:
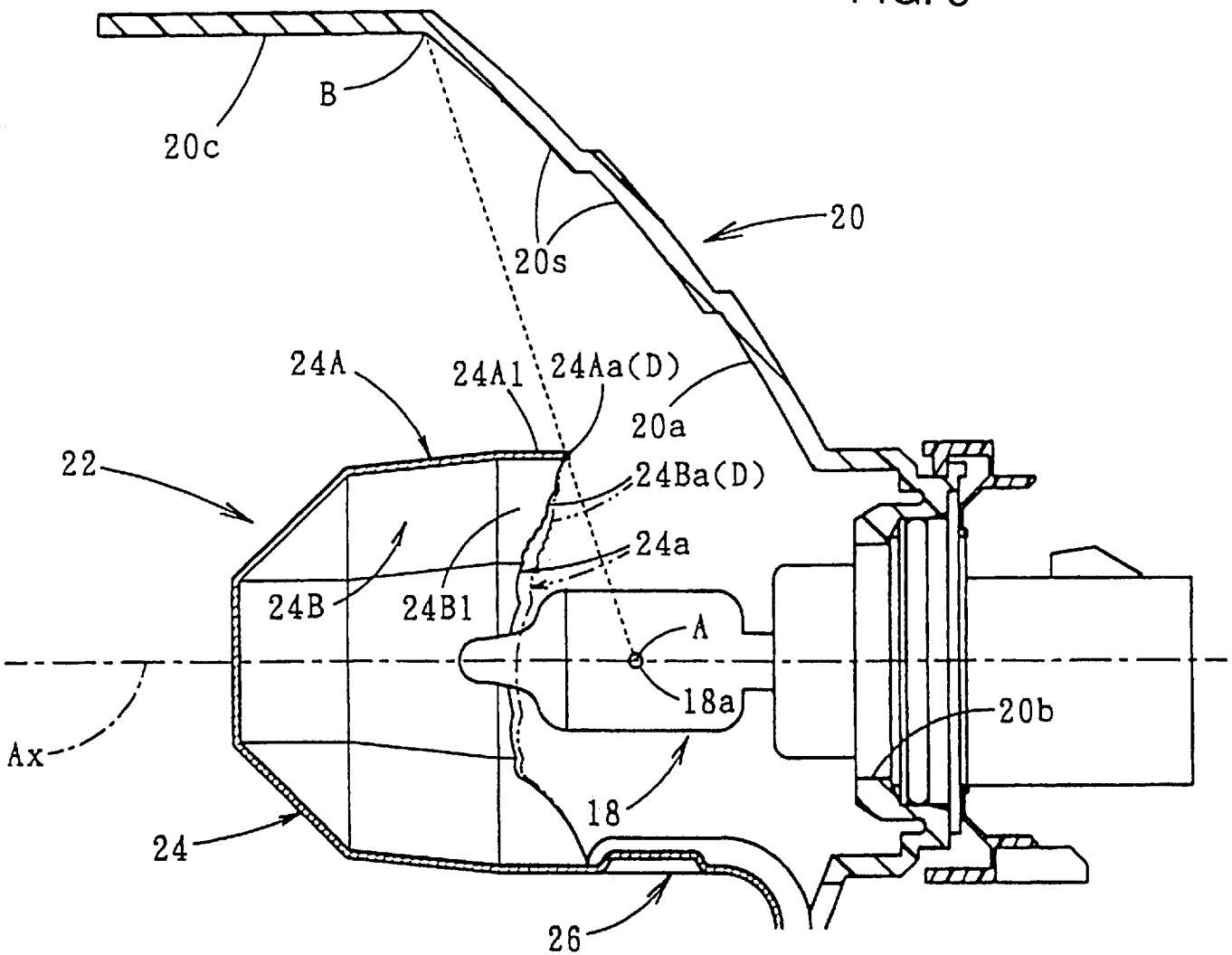
FIG. 3 is a detailed drawing of the principal part of FIG. 1.
Figure 4:
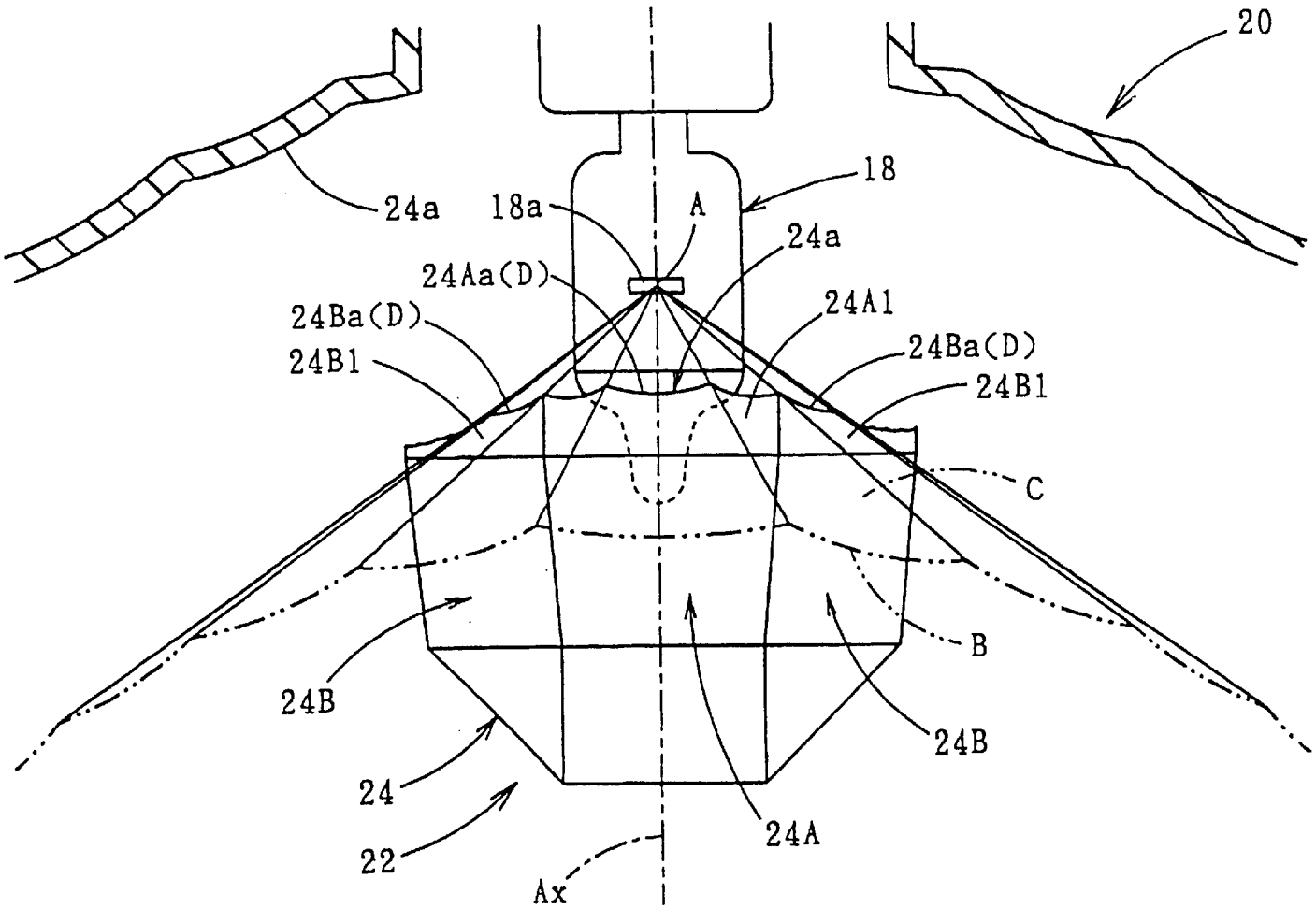
FIG. 4 is a view taken in the direction of an arrow IV of FIG. 2.
Figure 5:
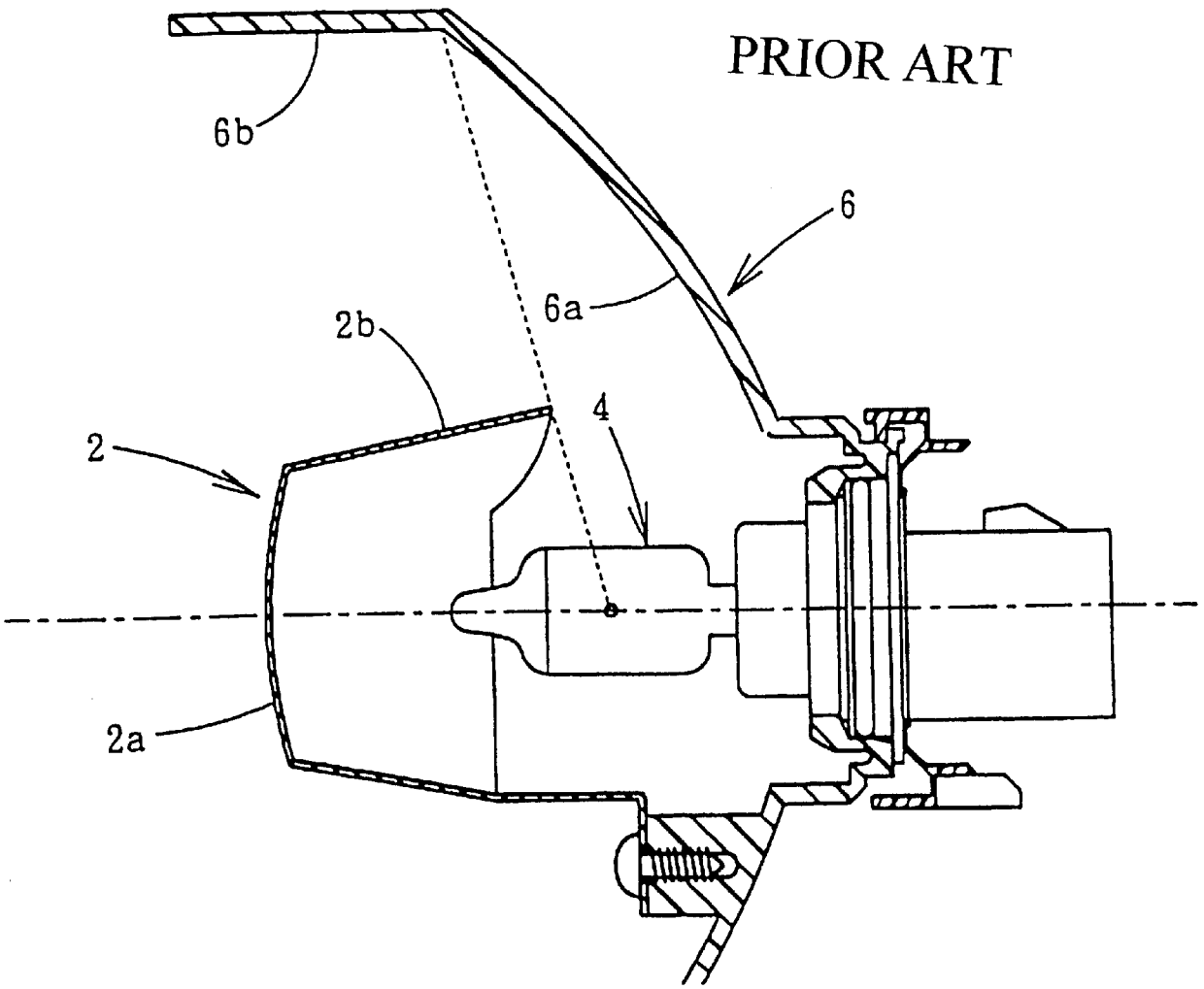
FIG. 5 PRIOR ART
FIG. 5 is a sectional side view of the principal part of a conventional vehicular headlamp.

FIG. 3 is a detailed drawing of the principal part of FIG. 1; and FIG. 4, a view taken in the direction of an arrow IV of FIG. 2.

As shown in FIGS. 3 and 4, an area 24A1 near the rear end edge of the upper end portion 24A of the shielding cap 24 is formed into a horizontal plane. The rear end edge 24Aa of the upper end portion 24A is set to have a curved configuration obtainable from a line of intersection D between a horizontal plane forming an area 24A1 near the rear end edge of the upper end portion 24A and an imaginary curved plane C formed by connecting together the light emission center A of the light source bulb 18 and the upper end edge (i.e., a line of intersection between the reflective surface 20*a* and the upper wall surface 20*c*) B of each reflective element 20*s* forming an area 24a1 near the upper end portion of the reflective surface 20*a*.

With respect a tilted portion 24B positioned on both lateral sides of the upper end portion 24A of the shielding cap 24, the rear end edge 24Ba is also set to have a curved configuration obtainable from a line of intersection D between a 45° tilted plane forming an area 24B1 near the rear end edge of the tilted portion 24B and an imaginary curved plane C formed by connecting together the light emission center A of the light source bulb 18 and the upper end edge (i.e., a line of intersection between the reflective surface 20*a* and the upper wall surface 20*c* or a curved plane rounding the surface in both directions) B of each reflective element 20*s* forming an area 24a1 near the upper end portion of the reflective surface 20*a*.

The remaining portion at the rear end edge 24*a* of the shielding cap 24 is also configured like the upper end portion 24A and the tilted portion 24B.

As set forth above in detail, since the reflective surface 20*a* of the reflector 20 is constituted of the plurality of reflective elements 20*s* that are the divided rectangular segments each of which is longer than is wide according to this embodiment of the invention, the upper end edge B of the reflective surface 20*a* has the curved configuration having irregularities in the respective reflective elements 20*s*. However, the rear end edge 24Aa in the upper end portion 24A of the shielding cap 24 of the shade 22 is set to have the curved configuration obtained from the line of intersection D between the horizontal plane forming the area 24A1 near the rear end edge of the upper end portion 24A and the imaginary curved plane C, whereupon the incidence of light on the upper wall surface 20*c* can be stopped substantially without impeding the incidence thereof on the reflective surface 20*a*.

Therefore, even in the case where the reflective surface is constituted of the plurality of reflective elements in the vehicular headlamp fitted with the shade according to this embodiment of the invention, the generation of stray light can be minimized while a decrease in utilization luminous flux is reduced to the minimum.

Since the area 24A1 near the rear end edge of the upper end portion 24A of the shielding cap 24 is formed into the horizontal plane according to this embodiment of the invention, moreover, it is possible to not only relatively easily calculating the line of intersection between the curved plane (the horizontal plane) forming the area 24A1 near the rear end edge thereof and the imaginary curved plane C but also machining the rear end edge 24Aa of the upper end portion 24A of the shielding cap 24.

In such a case that the low-beam filament 18*a* of the light source bulb 18 is so disposed as to extend in the horizontal direction perpendicular to the optical axis Ax particularly in the vehicular headlamp 10 according to this embodiment of the invention, the adoption of the aforementioned shade 22 is very effective as luminous flux incident on a boundary portion relative to the upper wall surface 20*c* of the reflective surface 20*a* tends to become extremely great.

Since the lateral width of each segment out of the plurality of the reflective elements 20*s* constituting the area 24a1 near the upper end portion of the reflective surface 20*a* of the reflector 20 is gradually set to a greater value as the reflective element 20*s* is positioned closer to the optical axis Ax according to this embodiment of the invention, control of stopping the incidence of light on the upper wall surface 20*c* can be effected with precision without impeding the incidence of light on the aforementioned reflective surface 20*a*.

What is claimed is:

1. A vehicle headlamp comprising:

a light source bulb;

a reflector disposed behind and over the light source bulb, said reflector comprising vertically-striped reflective elements;

an upper wall surface extending forward from said reflector; and a shade including a shielding cap disposed in front of the light source bulb, wherein an edge of said shielding cap, positioned near the light source bulb, abuts an imaginary curved plane formed by connecting together a center of said light source bulb to an edge between the upper wall surface and each reflective element of the reflector.

2. A vehicular headlamp as claimed in claim 1, wherein a curved plane forming an area near the rear end edge in the upper end portion of said shielding cap is formed into a substantially horizontal plane.

3. A vehicular headlamp as claimed in claim 2, wherein said shielding cap externally in the form of a polygon having a regular octagonal shape.

4. A vehicular headlamp as claimed in claim 1, wherein said reflective surface is in a form of a rotary parabolic shape with respect to an optical center axis on which said light source bulb is positioned.

5. A vehicular headlamp as claimed in claim 4, wherein said plurality of reflective elements are divided rectangular segments each of which is longer than is wide.

6. A vehicle headlamp comprising:

a light source bulb;

a reflector disposed behind and over the light source bulb, said reflector comprising vertically-striped reflective elements;

an upper wall surface extending forward from said reflector; and a shade including a shielding cap disposed in front of the light source bulb;

wherein the shielding cap is configured such that an imaginary line from the center of the light source bulb to an edge between the upper wall surface and each of the reflective elements of the reflector touches an edge of the shielding cap.

* * * * *